United States Patent [19]

White et al.

[11] 4,409,777

[45] Oct. 18, 1983

[54] WEB THREADING APPARATUS

[75] Inventors: Kenneth D. White, Grapevine; William R. Watson, Jr., De Soto, both of Tex.

[73] Assignee: Infra Pak (Dallas), Inc., Dallas, Tex.

[21] Appl. No.: 250,061

[22] Filed: Apr. 1, 1981

[51] Int. Cl.[3] ..... B65B 11/04; B65B 13/02; G03B 1/56

[52] U.S. Cl. ..... 53/587; 53/211; 53/214; 226/92

[58] Field of Search ..... 226/117, 91, 92, 170, 226/171; 242/47.03, 74; 53/587, 556, 211, 212, 213, 214; 352/157, 150

[56] References Cited

U.S. PATENT DOCUMENTS

| | | | |
|---|---|---|---|
| 731,008 | 6/1903 | Wyckoff | 242/74 X |
| 977,501 | 12/1910 | Bailey | 226/114 X |
| 1,676,305 | 7/1928 | Weldon | 226/91 X |
| 1,740,605 | 12/1929 | Klein | 226/92 |
| 2,545,015 | 3/1951 | Barker | 242/47.03 |
| 2,794,542 | 6/1957 | Vandenburgh et al. | 226/92 X |
| 3,120,198 | 2/1964 | Reid | 226/170 X |
| 3,443,371 | 5/1969 | Ward | 226/92 X |
| 4,302,920 | 12/1981 | Lancaster et al. | 53/556 X |

*Primary Examiner*—Stuart S. Levy
*Assistant Examiner*—Scott J. Haugland
*Attorney, Agent, or Firm*—Kenneth R. Glaser

[57] ABSTRACT

An elongated, resilient member such as a coiled spring or a belt of elastic material is disposed in lapping engagement with first and second drive rollers for engaging and threading a web around the rollers in response to rotation of the rollers. The drive rollers are rotated in opposite directions and the belt or spring is disposed in a twist, thereby defining a figure "8" lapping pattern. In a preferred embodiment, each roller is circumscribed by a groove in which the spring or belt is reeved.

2 Claims, 3 Drawing Figures

WEB THREADING APPARATUS

BACKGROUND OF THE INVENTION

1. Field of the Invention

The present invention relates generally to apparatus for tensioning web wrapping material, and more particularly, to method and apparatus for automatically threading a web of wrapping material around a plurality of rollers.

2. Description of the Prior Art

In a number of important industrial applications, a web is advanced from a feedstock roll to an operating station over a plurality of rollers, one or more of which are driven. In some installations the web may be threaded around the rollers by hand. Manual threading is difficult where access to the rollers is limited. Moreover, manually threading the web is time consumming and presents a risk of personal injury by exposing the operator to power driven components. Some web material, for example stretchable film of the type used for unitizing pallet loads, is very flexible and therefore relatively difficult to manipulate around the rollers.

Recent improvements in film web pretensioners for unitizing pallet loads utilize one or more driven rollers. In a typical dual drive arrangement, the film web undergoes stretching by the tensioner assembly as it is dispensed from a feedstock roll. The tensioner assembly includes two driven rollers which pull the film web from the feedstock roll which is coupled to a brake for maintaining a drag force on the feedstock roll. The film web is stretched in a first stage between the feedstock roll and the first drive roller. A second stage of stretching occurs between the first driven roller and the second driven roller. Finally, the film web undergoes a third stage of stretching between the second driven roller and the pallet load.

The foregoing web pretensioner and dispenser assembly is utilized on high speed conveyor lines in which pallet loads are unitized by stretchable film web on a mass production basis. Although the pretensioner apparatus greatly increases the coverage of a roll of film, it is necessary to insert a new roll of film web material from time-to-time as each roll is used up, or when changing over to a film material of a different thickness or grade for a new wrapping operation. For high speed, mass production operations, downtime is very expensive. Therefore, it is desirable to minimize the downtime associated with the change-over of the film feedstock roll. Present procedures which involve manual threading of the film web are time consumming because of the limited access to the drive rollers, and also expose the operator to the risk of personal injury.

A further problem relating to the threading of a stretchable film web around two or more drive rollers is that the film web has a tendency to cling to the surface of the drive rollers. Moreover, the drive rollers usually are provided with a jacket of rubber or other material which enhances the clinging effect. Because of this, the film becomes wrinkled and misaligned with the feedstock roll as it is threaded around the drive rollers.

SUMMARY OF THE INVENTION

It is, therefore, the principal object of the present invention to provide method and apparatus for automatically threading a web around a plurality of rollers, in which only minimal operator assistance is required.

A related object of the invention is to provide method and apparatus for automatically threading a stretchable film web around first and second drive rollers and a film pretensioner assembly in which the drive rollers are rotated in opposite directions.

According to the broadest aspects of the invention, the foregoing objects are achieved by an elongated, resilient member such as a coiled spring or a belt of elastic material disposed in lapping engagement with the first and second rollers for engaging and threading a web around the rollers in response to rotation of the rollers. When the drive rollers are rotated in opposite directions, the belt or spring is disposed in a twist, thereby defining a figure "8" lapping pattern.

The threading operation requires minimal operator assitance by first withdrawing the tail of the web from a feedstock roll and securing a fold of the web against the first roller by the circumscribing portion of the elongated, elastic member. The tail of the web is pulled along with the belt or spring in response to rotation of the rollers. For the arrangement in which the drive rollers rotate in opposite directions, the tail of the web is pulled around and lapped against the first drive roller, and thereafter is threaded through the space between the two drive rollers as it approaches the second drive roller. The web is then guided around the second drive roller by the threading spring.

After the threading operation is completed, the operator stops the rotation of the drive rollers and removes the web fold from engagement with the threading spring. The drive rollers are then rotated until the tail of the web is in a position to be secured to the pallet load, at which point the unitizing operation can begin.

In a preferred embodiment, the threading spring is received within grooves which circumscribe each drive roller. According to this arrangement, the threading spring is readily available at all times for a threading operation, but does not interfere with normal dispensing and pretensioning operations.

The novel features which characterize the present invention are defined by the appended claims. The foregoing and additional objects and advantages of the invention will hereinafter appear and for purposes of illustration, but not of limitation, a preferred embodiment is shown in the drawings.

DETAILED DESCRIPTION OF THE PREFERRED EMBODIMENT

Figure 1:
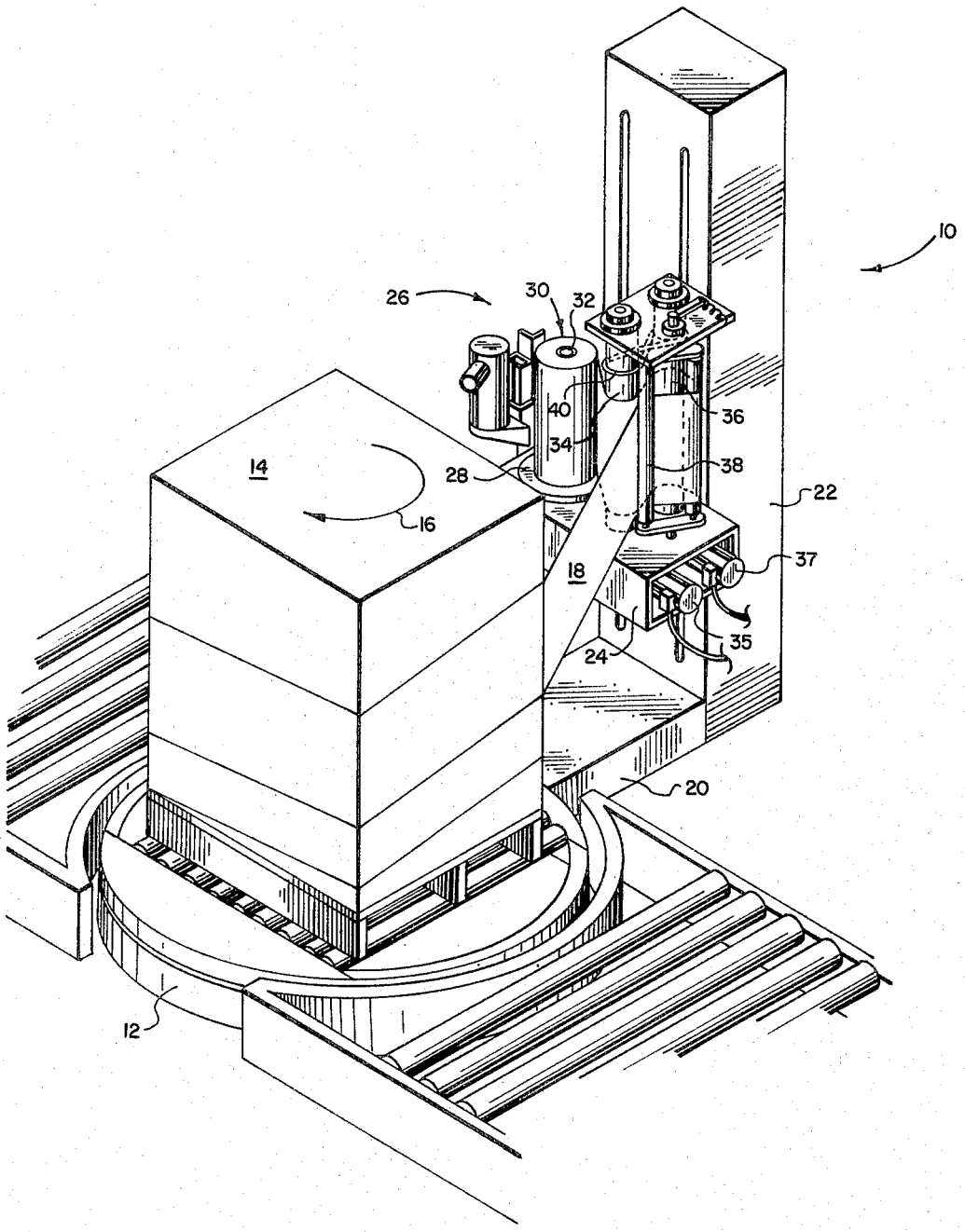
FIG. 1 is a perspective view of an automated wrapping station having a web pretensioner and dispensing assembly.

In the description which follows, like parts are marked throughout the specification and drawings with the same reference numerals, respectively. The drawings are not necessarily to scale and in some instances, portions have been exaggerated in order to more clearly depict certain features of the invention.

The invention will now be described in combination with an automated wrapping station wherein a stretchable film web is wrapped in a helical pattern around a vertical pallet load. It should be understood, however, that the principles of the invention are applicable to other web dispensing operations, including vertical, horizontal, upside down or overhead counter-rotating dispensing operations, in which a web of material is pulled from a feedstock roll over two or more rollers, at least one of which is driven. It should further be understood that the invention may be used to good advantage for threading various web materials, including web materials which resist stretching such as netting, paper, metallic sheeting and non-resilient polymer webs.

Referring to FIG. 1 an automated wrapping station for pretensioning and applying stretchable wrapping material to a pallet load is designated generally by the reference numeral 10. A turntable 12 supports a palletized load 14. The turntable 12 is of a type conventional in the art, and the associated mechanism for driving the turntable 12 and handling the palletized load 14 are not illustrated. In operation, the turntable 12 rotates in a clockwise direction as indicated by the arrow 16.

The palletized load 14 is wrapped in a helical pattern by at least one layer of wrapping material 18. The wrapping material 18 is preferably a stretchable plastic film web of a type commonly used for unitizing palletized loads.

A base 20 is mounted on the floor adjacent to the turntable 12. A support tower 22 is coupled to the base 20, and extends vertically therefrom. Inside the tower 22, an endless drive chain is engaged by a lower sprocket and an upper sprocket which are coupled in driving engagement with a reversible electric motor (not illustrated). An elevator carriage block 24 is coupled to the drive chain, and is slidably mounted on the outside of the support tower 22. The elevator block 24 is driven up and down the support tower by the electric motor and drive chain assembly.

Mounted on top of the elevator block 24 is a web dispenser and pretensioner assembly 26. The web dispenser and pretensioner assembly includes a mandrel 28 rotatably mounted on the upper surface of the elevator block 24. A feedstock roll 30 is received on the mandrel around a mandrel shaft 32. The feedstock roll 30 is rigidly secured to the mandrel by a core lock (not illustrated) carried by the mandrel shaft 32. The mandrel 28 utilizes a conventional, variable resistance brake (not illustrated) to maintain a predetermined drag on the feedstock roll 30. The drag level is preset according to the type of film, the rpm of the turntable, and the percent stretch desired. The applied braking force is automatically increased and decreased to maintain the desired drag level.

After leaving the feedstock roll 30, the film web 18 is engaged by a first drive roller 34 and thereafter around a second drive roller 36. The routing of the web 18 around the first and second drive rollers can best be seen in FIG. 3. Each drive roller 34, 36 is covered with a non-slip material such as rubber which provides good frictional engagement with the web material 18.

The drive rollers 34, 36 are driven independently by variable speed electric motors 35, 37, respectively. The brake assembly maintains a substantially constant tension in the section of web between the feedstock roll 30 and the first drive roller 34, whereby the web 18 undergoes a first stage of stretching as it is pulled off the feedstock roll. The second drive roller 36 is driven by an electric drive motor at a rotational speed which exceeds the rotational speed of the first drive roller, so that the film web 18 undergoes a second stage of stretching between the first drive roller and the second drive roller. Most of the stretching of the film web 18 occurs in the first and second stages, with the result that there is a relatively small pulling force applied by the pallet load to the film 18 in the third stage as it is pulled in response to rotation of the turntable.

In operation, the film web 18 is wrapped around the palletized load 14 in a helical pattern as the turntable 12 is rotated and the pretensioner assembly is simultaneously moved up and down the tower 22 by the electric drive mechanism. Because of the stretching affect produced by the drive rollers, the film web 18 is wrapped around the palletized load after undergoing substantially complete elongation beyond its memory threshold. Uneven pulling forces applied by the rotating load 14 are compensated by a dancer roller assembly 38 which is disposed in the web delivery path between the second drive roller 36 and the pallet load 14.

It will be appreciated that the pretensioner apparatus 26 greatly increases the coverage of a roll of film for pallet unitizing operations. However, it is sometimes necessary to insert a new feedstock roll 30 of film web material from time to time as each roll is used up, or when changing over to a film web of a different thickness or grade for a different wrapping operation. For sake of economy, it is desirable to minimize the downtime associated with the change-over of the film feedstock roll. Conventional threading operations in which the film material is manually pulled from the feedstock roll and threaded around the drive rollers 34, 36 are time consuming because of the limited access to the drive rollers and also expose the operator to risk of personal injury by exposure to the power driven components. The manual threading operation is complicated by the tendency of the film web to cling to the surface of the drive rollers, resulting in wrinkling and misalignment of the web with the feedstock roll as it is threaded around the drive rollers.

Figure 2:
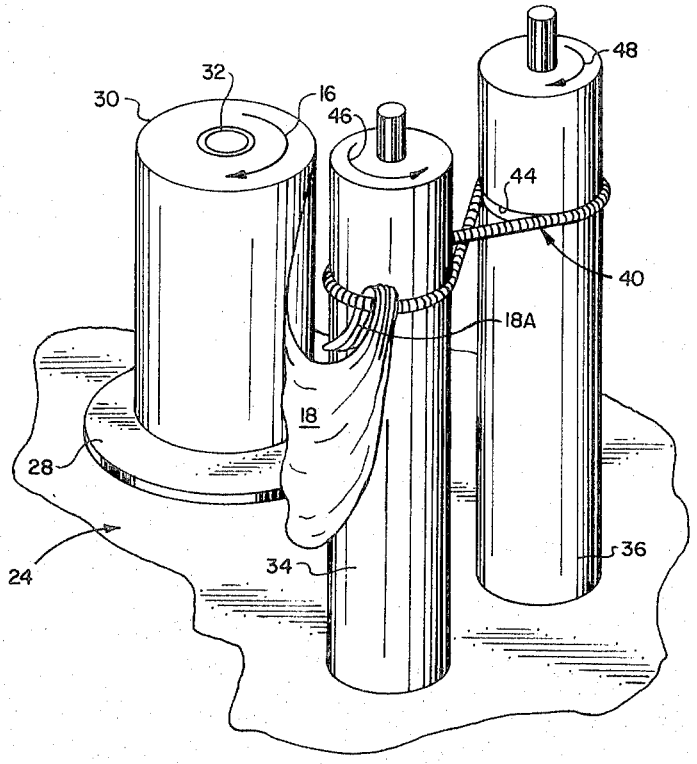
FIG. 2 is a partial perspective view of a drive roller sub-assembly of the pretensioner assembly of FIG. 1; and, FIG. 3 is a plan view of the drive roller assembly of FIG. 2.

Automated threading is carried out according to the present invention by an elongated coiled spring 40 which is disposed in a twist, thereby defining a figure "8" lapping pattern around the drive rollers 34, 36 as illustrated in FIG. 2. Preferably, each drive roller 34, 36 is circumscribed by grooves 42, 44, respectively, in which the coiled spring 40 is received. This grooved arrangement retains the spring 40 in position during rotation of the drive rollers.

The drive rollers are rotated in opposite directions as illustrated by the arrows 46, 48. Additionally, drive roller 36 is driven at a slightly faster rate than drive roller 34 to obtain second stage prestretching of the film web 18. Thus, it is desirable that the spring threading member 40 be elastic or resilient to yield slightly as it is pulled around the drive rollers. Because of the differential rotation, the coiled spring threading member 40 slips in the groove 42 on drive roller 34 during normal dispensing operation. However, during a threading operation in which the tail of the web 18 is folded over and tucked between the spring 40 and the groove 42, the spring becomes seized by the resulting frictional engagement with the result that the intermediate portion of the spring must yield slightly as the web 18 is lapped around the drive rollers.

Figure 3:
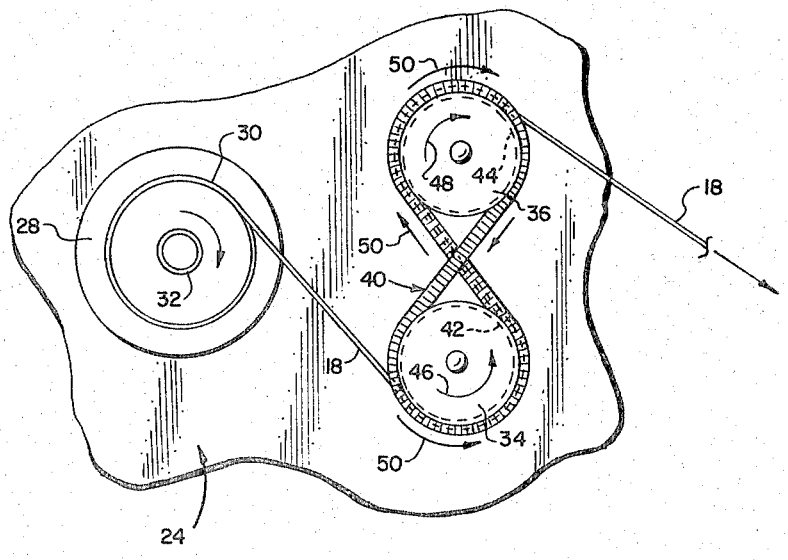

Referring to FIGS. 2 and 3, the threading operation is initiated by pulling the tail 18A of the web 18 from the feedstock roll 30 and securing a fold of the tail 18A between the coiled spring 40 and the first driven roller 34. The drive rollers 34, 36 are then rotated in opposite directions indicated by the arrows 46, 48, with the result that the web tail 18A is pulled away from the feedstock roll 30 along the direction of the arrows 50. In completing this transit, the web tail 18A defines a figure "S" as can best be seen in FIG. 3.

When the web tail 18A has negotiated the second drive roller 36, rotation of the drive rollers is stopped temporarily while an operator removes the tail 18A from engagement with the spring 40. After this operation is performed, the drive rollers are again rotated, with the web 18 being played out until the tail 18A is brought to a position adjacent the turntable 12 wherein it can be secured to the pallet load 14. After the tail 18A is secured to the pallet load, the wrapping operation is commenced, with the coiled spring threading member 40 being retained on the rollers 34, 36 by engagement with the grooves 42, 44.

It will be appreciated that the foregoing web threading operation can be carried out without regard to relative speed of rotation of the first and second drive rollers, and is equally applicable for use in an undriven roller/driven roller combination.

Although a preferred embodiment of the invention has been described in detail, it should be understood that various changes, substitutions and alterations can be made therein without departing from the spirit and scope of the invention as defined by the appended claims.

What is claimed is:

1. In a process for automatically wrapping stretchable wrapping material around a plurality of units placed on a rotatable turntable in order to unitize the units, wherein the stretchable material is pulled from a feedstock roll and prestretched by a pair of rollers disposed between the feedstock roll and the units and defining upstream and downstream rollers, the improvement comprising:

(a) pulling a leading end of said wrapping material from said feedstock roll;

(b) securing said leading end of said wrapping material to the upstream one of said rollers by a mechanism which constrains the wrapping material to pass into engagement with both the upstream and downstream rollers;

(c) rotating the said rollers to advance said leading end toward said turntable;

(d) interrupting the rotation of said rollers when said leading end has advanced to a location past the downstream roller;

(e) releasing the said leading end from said mechanism and from engagement with said downsteam roller;

(f) thereafter advancing said leading end to a location immediately adjacent said plurality of units; and (g) securing said leading end to at least one of said units.

2. The process as defined by claim 1 wherein the advancing of said leading end to a location immediately adjacent said plurality of units is effected by powering the rollers into rotation.

* * * * *